US008632422B2

(12) United States Patent
Iizuka

(10) Patent No.: US 8,632,422 B2
(45) Date of Patent: Jan. 21, 2014

(54) MULTI-PIECE SOLID GOLF BALL

(75) Inventor: Kae Iizuka, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/240,580

(22) Filed: Sep. 22, 2011

(65) Prior Publication Data

US 2013/0079179 A1 Mar. 28, 2013

(51) Int. Cl.
*A63B 37/12* (2006.01)

(52) U.S. Cl.
USPC ..... 473/378

(58) Field of Classification Search
USPC ..... 473/378
See application file for complete search history.

(56) References Cited

U.S. PATENT DOCUMENTS

| | | | | |
|---|---|---|---|---|
| 6,336,870 | B1 * | 1/2002 | Kato et al. | 473/351 |
| 6,824,479 | B2 | 11/2004 | Isogawa et al. | |
| 7,278,931 | B2 * | 10/2007 | Manami et al. | 473/378 |
| 2009/0023518 | A1 * | 1/2009 | Lee et al. | 473/376 |

FOREIGN PATENT DOCUMENTS

JP 2004-166719 A 6/2004

* cited by examiner

*Primary Examiner* — Raeann Gorden
(74) *Attorney, Agent, or Firm* — Sughrue Mion, PLLC

(57) ABSTRACT

The invention provides a multi-piece solid golf ball having a core, a cover of at least one layer encasing the core, and a layer of paint applied to a surface of an outermost layer of the cover, wherein the outermost cover layer or an inner cover layer adjacent to the outermost layer is formed of a resin composition which includes:

(a) 100 parts by weight of a thermoplastic resin,
(b) from 0.003 to 2 parts by weight of a color pigment or dye, and
(c) from 0.01 to 20 parts by weight of spherical inorganic fine particles as a reflective material.

The golf ball has a novel appearance that is bright and highly visible, and also has an excellent durability.

11 Claims, No Drawings

MULTI-PIECE SOLID GOLF BALL

BACKGROUND OF THE INVENTION

This invention relates to a multi-piece solid golf ball which is a pastel-colored golf ball wherein a color pigment or the like has been included in the resin composition making up at least one layer of the cover encasing the core, and which moreover has a multilayer ball construction.

Golf balls having a surface color that is white have hitherto been used. Recently, however, both men and women golfers are making considerable use of colored balls at golf courses. Using a colored ball does not have merely a visual effect; depending on the particular golfer, if may also have good psychological effects. For example, on shots with a driver and approach shots, if the surface color of the ball is a warm hue such as yellow, orange or pink, this may have a reassuring and calming effect on the player, resulting in fewer missed shots and making the ball more psychologically beneficial than a ball having a white color.

Moreover, when the golf ball gets into the rough or into trees and other vegetation and cannot easily be found, using a colored ball having a surface color that is bright and highly visible can provide a competitive advantage relative to the white golf balls that are generally used. Therefore, when using a colored ball, it is desirable for the ball to have an increased visibility. To achieve golf balls having a bright or luminous appearance, effect pigments such as various metal oxides have hitherto been blended into the golf ball cover material or paint (see, for example, JP-A 2004-166719).

However, including an effect pigment in a golf ball material may alter the hardness and flexural rigidity of the cover or the like, lowering the flight performance of the ball, and may worsen the durability. Therefore, when an effect pigment is included in the cover or the like, it is necessary to adjust the material and amount thereof in such a way as not to adversely affect the basic characteristics required of the ball.

Concerning the types of golf balls in common use recently, three-piece solid golf balls in which the core is encased by a cover of two or more layers have come to be more commonly used than two-piece solid golf balls. Not only do three-piece golf balls have an excellent flight performance, when a highly neutralized ionic material is used as the chief material in the cover layer (intermediate layer) between the core and the outermost cover layer, the spin performance on approach shots can be optimized, in addition to which a good feel on impact can be obtained.

Yet, among highly neutralized ionic materials, those with a high acid content have a poor durability. Moreover, ionic resins with a high acid content often have a melt flow index (MI) that is too low, making injection molding difficult to carry out, as a result of which the workability in golf ball production sometimes worsens.

In addition, golf balls in which efforts have been made to increase the durability through the use of an inorganic filler or the like have also been disclosed. Unfortunately, owing to the combination of the shape of the inorganic filler with the molding method, an orientation caused by the inorganic filler arises, which has made it impossible to obtain the desired effects.

The inventor has already described, in the specification of U.S. patent application Ser. No. 13/178,822, a golf ball material which, by blending a nonionic polymer having a high acid content with a nonionic polymer having a low or moderate acid content, confers the ball with a high rebound and a low spin rate, and moreover which, through the use of a spherical inorganic filler, increases the durability of the ball. However, because golf balls obtained using this golf ball material lack visibility and brightness, such a material cannot be regarded as one that enhances the ball's appearance.

SUMMARY OF THE INVENTION

It is therefore an object of the present invention to provide a multi-piece solid golf ball which, while retaining the excellent rebound and increased distance imparted by the multi-layer structure of the ball, additionally has an appearance characterized by brightness and high visibility, and is moreover endowed with an excellent durability.

As a result of extensive investigations, the inventor has discovered that, in a multi-piece solid golf ball having a core, a cover of at least one layer encasing the core and a layer of paint applied to a surface of an outermost layer of the cover, by including specific amounts of a color pigment or dye and of spherical inorganic fine particles serving as a reflective material in a resin composition for the outermost layer of the cover or for an inner cover layer adjacent to the outermost layer, the multi-layer structure imparts the ball with an excellent rebound and increased distance, the ball has an appearance characterized by brightness and a sufficiently high visibility, and the ball moreover has an excellent durability.

Accordingly, the present invention provides the following multi-piece solid golf balls.

[1] A multi-piece solid golf ball comprising a core, a cover of at least one layer encasing the core, and a layer of paint applied to a surface of an outermost layer of the cover, wherein the outermost cover layer is formed of a resin composition comprising:
  (a) 100 parts by weight of a thermoplastic resin,
  (b) from 0.003 to 2 parts by weight of a color pigment or dye, and
  (c) from 0.01 to 20 parts by weight of spherical inorganic fine particles as a reflective material.

[2] The multi-piece solid golf ball of [1], wherein the spherical inorganic fine particles serving as a reflective material (c) are made of a glass material.

[3] The multi-piece solid golf ball of [1], wherein the spherical inorganic fine particles are glass beads.

[4] The multi-piece solid golf ball of [1], wherein the glass material is selected from the group consisting of NaO—CaO—$SiO_2$ glasses, $Al_2O_3$—$B_2O_3$—$SiO_2$ glasses, CaO—$Al_2O_3$—$SiO_2$ glasses and $TiO_2$—BaO—$SiO_2$ glasses.

[5] The multi-piece solid golf ball of [4], wherein the glass material has the following oxide equivalent composition:
  (i) when a NaO—CaO—$SiO_2$ glass is used, the oxide equivalent composition is 0.5 to 45 wt % of NaO, 0.5 to 45 wt % of CaO, and 40 to 90 wt % of $SiO_2$;
  (ii) when an $Al_2O_3$—$B_2O_3$—$SiO_2$ glass is used, the oxide equivalent composition is 0.5 to 40 wt % of $Al_2O_3$, 0.5 to 40 wt % of $B_2O_3$, and 40 to 90 wt % of $SiO_2$;
  (iii) when a CaO—$Al_2O_3$—$SiO_2$ glass is used, the oxide equivalent composition is 0.5 to 45 wt % of CaO, 0.5 to 40 wt % of $Al_2O_3$, and 40 to 90 wt % of $SiO_2$;
  (iv) when a $TiO_2$—BaO—$SiO_2$ glass is used, the oxide equivalent composition is 0.5 to 45 wt % of $TiO_2$, 0.5 to 40 wt % of BaO, and 40 to 90 wt % of $SiO_2$.

[6] The multi-piece solid golf ball of [1], wherein the spherical inorganic fine particles serving as a reflective material (c) have a sphericity (ratio of maximum particle length/minimum particle width) of from 1.00 to 2.00.

[7] The multi-piece solid golf ball of [1], wherein the spherical inorganic fine particles serving as a reflective material (c) contain a retroreflective material.

[8] The multi-piece solid golf ball of [1], wherein the color pigment serving as component (b) is selected from the group consisting of red pigments, blue pigments, yellow pigments, green pigments, violet pigments and black pigments.

[9] A multi-piece solid golf ball comprising a core, a cover of at least one layer encasing the core, and a layer of paint applied to a surface of an outermost layer of the cover, wherein the outermost cover layer is clear and an inner cover layer adjacent to the outermost layer is formed of a resin composition comprising:

(a) 100 parts by weight of a thermoplastic resin, (b) from 0.003 to 2 parts by weight of a color pigment or dye, and (c) from 0.01 to 20 parts by weight of spherical inorganic fine particles as a reflective material.

DETAILED DESCRIPTION OF THE INVENTION

The invention is described more fully below.

The golf ball of the invention has a multilayer structure which, although not shown in an accompanying diagram, includes a core, a cover of at least one layer encasing the core, and a layer of paint applied to a surface of an outermost layer of the cover. In addition, numerous dimples are generally formed on the surface of the outermost cover layer.

The core used in the invention is not limited to a single layer, and may instead be a multilayer core. No particular limitation is imposed on the core material. For example, use may be made of a material obtained by molding and vulcanizing a rubber composition prepared by blending a known rubber material such as cis-1,4-polybutadiene as the base material together with a co-crosslinking agent such as an unsaturated carboxylic acid or a metal salt thereof, an inorganic filler such as zinc oxide or barium sulfate, and an organic peroxide such as dicumyl peroxide or 1,1-bis(t-butylperoxy)cyclohexane. In the present invention, no particular limitation is imposed on the core diameter. Nor is any particular limitation imposed on the color of the core.

The cover used in the invention is formed of at least one layer. An outermost layer of the cover is formed of a resin composition which contains the following components (a) to (c) as the essential ingredients:

(a) thermoplastic resin, (b) color pigment or dye (c) spherical inorganic fine particles as a reflective material.

The resin composition accounts for at least 60 wt %, preferably at least 70 wt %, and more preferably at least 80 wt %, of the outermost cover layer. Components (a) to (c) are each described below.

(a) Thermoplastic Resin

The thermoplastic resin serving as component (a) is the chief material of the outermost cover layer. Use may be made of any of various known types of thermoplastic resins without particular limitation. Specifically, preferred use may be made of olefinic thermoplastic resins and thermoplastic polyurethanes. Of these, the use of a nonionic resin such as an olefin-unsaturated carboxylic acid copolymer or an olefin-unsaturated carboxylic acid-carboxylic acid ester copolymer, or of an ionic resin or a thermoplastic polyurethane is more preferred. These may be used singly or as combinations of two or more thereof.

(b) Color Pigment or Dye

The color pigment or dye serving as component (b) is included for the purpose of adjusting the color of the ball. In the practice of the invention, a known pigment or dye may be used, although from the standpoint of resistance to discoloration, it may be preferable to use a pigment. Exemplary pigments include red pigments, blue pigments, yellow pigments, green pigments, violet pigments and black pigments. Examples of red pigments include those based on quinacridones; examples of blue pigments include those based on phthalocyanines; examples of yellow pigments include those based on mixed oxide pigments; examples of violet pigments include ultramarine violet, cobalt violet, manganese violet, dioxane violet and quinacridone violet; examples of black pigments include carbon black. By including these, it is possible to express deep pastel colors. These pigments may be used singly or as combinations of two or more thereof, the combinations or included amounts being suitably selected according to the ball specifications and other considerations. Commercial products may be used as the above pigments. Illustrative examples include the products available under the trade names Chromofine (from Dainichi Seika Color & Chemicals Mfg., Co., Ltd.), Tipaque Yellow (from Ishihara Sangyo Kaisha, Ltd.), and Tokablack (from Tokai Carbon Co., Ltd.). The amount in which component (b) is included per 100 parts by weight of the thermoplastic resin (a) may be set to preferably from 0.003 to 2 parts by weight, and more preferably from 0.005 to 1.5 parts by weight. When the amount of component (b) is too low, coloration of the ball surface may be poor. Conversely, when the amount is too high, ball surface coloration may be excessive, resulting in a loss of the pastel tone.

(c) Spherical Inorganic Fine Particles as Reflective Material

Illustrative, non-limiting, examples of the spherical inorganic fine particles serving as component (c) in the invention include spherical fine particles containing a glass material, alumina material, titanium material or silica material. A method which uses spherical glass beads is preferable for reflection.

In cases where a glass material is used as the spherical inorganic fine particles (c), selection from the group consisting of $NaO—CaO—SiO_2$ glasses, $Al_2O_3—B_2O_3—SiO_2$ glasses, $CaO—Al_2O_3—SiO_2$ glasses and $TiO_2—BaO—SiO_2$ glasses is preferred. Moreover, it is desirable for the glass material used to be any one of (i) to (iv) below having the indicated compositions.

(i) When a $NaO—CaO—SiO_2$ glass is used, the oxide equivalent composition is 0.5 to 45 wt % of NaO, 0.5 to 45 wt % of CaO, and 40 to 90 wt % of $SiO_2$.

(ii) When a $Al_2O_3—B_2O_3—SiO_2$ glass is used, the oxide equivalent composition is 0.5 to 40 wt % of $Al_2O_3$, 0.5 to 40 wt % of $B_2O_3$, and 40 to 90 wt % of $SiO_2$.

(iii) When a $CaO—Al_2O_3—SiO_2$ glass is used, the oxide equivalent composition is 0.5 to 45 wt % of CaO, 0.5 to 40 wt % of $Al_2O_3$, and 40 to 90 wt % of $SiO_2$.

(iv) When a $TiO_2—BaO—SiO_2$ glass is used, the oxide equivalent composition is 0.5 to 45 wt % of $TiO_2$, 0.5 to 40 wt % of BaO, and 40 to 90 wt % of $SiO_2$.

When the above glass material is not used, compatibility with the synthetic resin serving as the base material may worsen and it may not be possible to ensure a sufficient durability. Various colorants and other additives may be formulated with the glass material. In addition, soda may be included in order to lower the melting point.

The spherical inorganic fine particles have a spherical shape. Common inorganic fillers have various shapes, including irregular shapes, flake-like shapes and needle-like shapes. When the golf ball is molded by an injection molding process or the like, such shapes give rise to an orientation, which may make the ball performance unstable and lead in particular to a decline in durability.

The spherical inorganic fine particles have a sphericity (ratio of maximum particle length/minimum particle width) in a range of from 1.00 to 2.00, preferably from 1.00 to 1.50, and more preferably from 1.00 to 1.30. The numerical value of the sphericity is a value measured by scanning electron microscopy (enlargement, 10,000×; n=100). At a value greater than the above range in the sphericity (maximum particle length/minimum particle width), the particle shape enters what is regarded as the "amorphous" region, and the flight performance of the ball may, as in the conventional art, fail to improve. Moreover, in this invention, by using a spherical material, orientation within the resin material can be suppressed without relying on the flow properties of the resin material during molding, thus making it possible to increase the durability of the cover material.

The average particle size of the spherical inorganic fine particles, although not subject to any particular limitation, is preferably from 0.1 to 1,000 μm, more preferably from 1 to 750 μm, and even more preferably from 25 to 500 μm. Moreover, the spherical inorganic fine particles preferably have some degree of particle size distribution, typically in a range of ±90% of the average particle size, more preferably in a range of ±70% of the average particle size, and even more preferably in a range of ±50% of the average particle size. If the average particle size is smaller than the above range, the amount of spherical inorganic fine particles added must be further increased to achieve a reinforcing effect. However, as a result, the resin specific gravity will be higher, which may limit the degree of freedom in ball design. On the other hand, if the average particle size is larger than the above range, the durability may decrease.

The spherical inorganic fine particles (c) are included in an amount, per 100 parts by weight of the thermoplastic resin serving as component (a), of at least 0.01 part by weight, preferably at least 1.0 part by weight, and more preferably at least 5.0 part by weight. The upper limit is 20 parts by weight or less, preferably 18 parts by weight or less, and more preferably 15 parts by weight or less. At an amount of (c) below 0.01 part by weight, a sufficient reinforcing effect cannot be obtained. On the other hand, an amount of (c) above 20 parts by weight may lead to a decline in durability. If too much component (c) is included, the ball visibility may worsen depending on the combination of component (c) with the type and amount of the pigment or dye used.

Also, it is desirable for the spherical inorganic fine particles (c) to have a reflective mechanism with retroreflectivity. "Retroreflectivity" refers to the mechanism of reflecting light back along the same trajectory on which it has arrived. Particularly in dense growths of vegetation and dark places, the ability to reflect light back in the direction of the light source greatly increases the visibility of the ball, making it possible to reduce the chances that the ball will be lost.

The above reflective mechanism can often be achieved with a material composed of spherical fine particles. In this invention, of the above-described glass materials (i) to (iv), it is preferable to use (iv) a $TiO_2$—BaO—$SiO_2$ glass ($TiO_2$ content, 0.5 to 45 wt %; BaO content, 0.5 to 45 wt %; $SiO_2$ content, 40 to 90 wt %), although the invention is not limited to this material.

Optional additives may be included in the resin composition of above components (a) to (c) as appropriate for the intended use. For example, various additives such as pigments, dispersants, antioxidants, ultraviolet absorbers and light stabilizers may be added. When such additives are included, they may be added in an amount of generally at least 0.1 part by weight, and preferably at least 0.5 part by weight, but generally not more than 10 parts by weight, and preferably not more than 4 parts by weight, per 100 parts by weight of above components (a) to (c) combined.

The method used to formulate and prepare the resin composition of components (a) to (c) may be one that involves charging the thermoplastic resin as component (a), together with components (b) and (c), into a hopper and extruding under the desired conditions. Preparing a masterbatch in which the thermoplastic resin (a) and the spherical inorganic fine particles (c) have been pre-blended is preferred because the dispersibility can be increased. The extruder used may be a single-screw extruder or a twin-screw extruder, although the use of a twin-screw extruder is preferred. Alternatively, these extruders may be used in a tandem arrangement, such as single-screw extruder/twin-screw extruder or twin-screw extruder/twin-screw extruder.

In cases where a separate cover layer is additionally present on the inner side of the outermost cover layer, the material of this cover layer (referred to below as the "inner cover layer") is not subject to any particular limitation. Use may be made of a known thermoplastic resin or thermoplastic elastomer, with the use of an ionic resin (ionomer resin) being preferred. The use of a heated mixture which is a composition of (i) to (iv) below is especially preferred.

(i) from 100 to 50 wt % of an olefin-unsaturated carboxylic aid-unsaturated carboxylic acid ester random copolymer and/or a metal salt thereof, and
(ii) from 0 to 50 wt % of an olefin-unsaturated carboxylic acid random copolymer and/or a metal salt thereof, in combination with
(iii) from 5 to 170 parts by weight of a fatty acid or fatty acid derivative having a molecular weight of from 280 to 1500 per 100 parts by weight of (i) and (ii) as the base resins, and
(iv) from 0.1 to 20 parts by weight of a basic inorganic metal compound capable of neutralizing the acid groups in components (i), (ii) and (iii).

The composition of (i) to (iv) above is an ionic resin having a good resilience. When such an ionic resin is used to form the inner cover layer, the surface of the inner cover layer sometimes ends up having a dull appearance. Hence, such a resin has not always been desirable as the inner cover layer material. However, as noted above, in this invention, by including spherical inorganic fine particles as a reflective material (c), the dull appearance can be suppressed and resilience can be imparted, enabling improvements to be achieved in both appearance and resilience.

The olefin used in components (i) and (ii) preferably has from 2 to 6 carbons; ethylene is especially preferred. The unsaturated carboxylic acid used in components (i) and (ii) may be, for example, acrylic acid (AA) or methacrylic acid (MAA); methacrylic acid (MAA) is especially preferred. From the standpoint of obtaining a suitable resilience and hardness, the unsaturated carboxylic acid ester used in components (i) and (ii) is preferably an alkyl ester; a lower alkyl ester having from 1 to 8 carbons is especially preferred. The use of butyl acrylate (butyl n-acrylate, butyl i-acrylate) is most preferred.

In the invention, it is essential to use component (i) and component (ii) together. Components (i) and (ii) are mixed in relative proportions by weight of preferably (i):(ii)=100:0 to 50:50. At a proportion of component (i) below the above range, a sufficient ball rebound may not be obtained. On the other hand, at a proportion of component (ii) greater than the above range, the durability of the ball may worsen.

Commercial products such as the Himilan and Nucrel series (available from DuPont-Mitsui Polychemicals Co., Ltd.), the Surlyn series (available from E.I. DuPont de Nemours & Co.) and the Escor series (available from ExxonMobil Chemical) may be used as components (i) and (ii).

Next, the fatty acid or fatty acid derivative (iii) is a compound having a molecular weight of from 280 to 1500. Although not subject to any particular limitation, the use of one or more selected from the group consisting of stearic acid, behenic acid, oleic acid, maleic acid, and metal salts thereof is preferred. The use of one or more selected from the group consisting of stearic acid, oleic acid, and mixtures thereof is especially preferred. The organic acid metal salt of component (iii) is preferably a metallic soap, with the metal salt making use of metal ions having a valence of from 1 to 3 which are preferably selected from the group consisting of lithium, sodium, magnesium, aluminum, potassium, calcium and zinc. The use of a metal salt of stearic acid is especially preferred. Specifically, the use of magnesium stearate, calcium stearate, zinc stearate or sodium stearate is preferred. Of these, the use of magnesium stearate is especially preferred.

Component (iii) is included in an amount, per 100 parts by weight of components (i) and (ii) as the base resins, of preferably from 5 to 170 parts by weight, and more preferably from 15 to 90 parts by weight. When component (iii) is included in too small an amount, it is difficult to ensure that the resin composition has sufficient flow properties. On the other hand, including too much component (iii) may worsen the durability of the golf ball.

Illustrative examples of the metal ions in the basic inorganic metal compound of above component (iv) include $Na^+$, $K^+$, $Li^+$, $Zn^{2+}$, $Ca^{2+}$, $Mg^{2+}$, $Cu^{2+}$ and $Co^{2+}$. Of these, $Na^+$, $Zn^{2+}$, $Ca^{2+}$ and $Mg^{2+}$ are preferred, and $Mg^{2+}$ is especially preferred. These metal salts may be introduced into the resin using, for example, formates, acetates, nitrates, carbonates, bicarbonates, oxides or hydroxides.

The basic inorganic metal compound is a component which is capable of neutralizing the acid groups in above components (i), (ii) and (iii). The amount of this compound included is set to an amount equivalent to at least 70 mol %, based on the acid groups in above components (i) to (iii). Here, the amount in which the basic inorganic metal compound serving as component (iii) is included may be selected as appropriate for obtaining the desired degree of neutralization. Although this amount depends also on the degree of neutralization of components (i) to (iii) that are used, in general it is preferably from 0.1 to 20 parts by weight per 100 parts by weight of components (i) to (iii) combined.

The degree of neutralization of the acid groups in above components (i) to (iii) is preferably at least 70 mol %, more preferably at least 75 mol %, and even more preferably at least 80 mol %. The upper limit is preferably not more than 120 mol %, more preferably not more than 110 mol %, and even more preferably not more than 100 mol %. If the above numerical range is not satisfied, the ball durability may be inferior and a high rebound may not be achieved. On the other hand, if the degree of neutralization is too high, a suitably soft material hardness will be difficult to achieve and the moldability during injection molding may worsen.

Moreover, in the invention, along with using the resin composition of above components (a) to (c) as the material which forms the inner cover layer adjoining the outermost cover layer, by also finishing the outermost cover layer as a clear layer, the desired effects of the invention can be achieved. In this case, a clear resin material such as an ionomer resin may be used as the outermost cover layer. Resins other than ionomer resins may also be used, provided they are resin materials which impart transparency.

Numerous dimples are formed on the surface of the outermost cover layer. The dimples make up numerous raised and recessed features on the surface of the outermost layer, the diameters, numbers and depths of which affect the appearance of the ball. Accordingly, it is preferable for the dimples to be provided in a range which does not detract from the effects of the invention. The number of such dimples, although not subject to any particular limitation, is preferably at least 250 but not more than 330. The surface ratio (SR) of the dimples that are formed on the surface of the ball, although not subject to any particular limitation, is preferably at least 80%, and more preferably at least 90%, but preferably not more than 98%, and more preferably not more than 95%. For example, if the number of dimples is too high, when light strikes the ball, the visibility effect of the colored ball may decrease. That is, depending on the angle from which the ball is seen, the bottoms of the dimples may fall into shadow, causing the ball to appear darker. Conversely, if the number of dimples is too small, it may not be possible to obtain good aerodynamic characteristics when the ball is hit, as a result of which the desired distance may not be achieved.

The method of producing a golf ball having the above cover may involve producing a molded and crosslinked rubber material (core) by vulcanizing a rubber composition composed primarily of polybutadiene or the like under known vulcanization conditions, then successively forming the cover of one or more layer (outermost layer, inner layer) over the core by a known process such as injection molding. Moreover, generally, in order to form numerous dimples on the surface of the ball, at the same time that the cover material is injection molded to form the outermost layer, dimples are formed by numerous protrusions which have been formed on the inside wall of the mold cavity.

Also, in the invention, a layer of paint is applied to the surface of the outermost layer of the cover. This paint layer, although not subject to any particular limitation, has a thickness of preferably at least 5 μm, and more preferably at least 10 μm, but preferably not more than 20 μm, and more preferably not more than 16 μm. If the paint layer is too thin, this may become a major factor in the loss of paint durability. On the other hand, if the paint layer is too thick, it may have a large influence on the dimple shape, possibly making it impossible to obtain a flight performance according to design, as a result of which a sufficient distance may not be achieved. If the paint layer is too thick, the paint may have a tendency to peel, as a result of which the durability to repeated impact may decrease.

In this invention, forming the above paint layer by clear coating (coating with a clear paint) is desirable from the standpoint of effectively achieving the objects of the invention. When a clear paint is to be used in such cases, it is preferable to employ a two-component curing urethane paint. Two-component curing urethane paints are made up of a polyol component having hydroxyl groups and a polyisocyanate component having isocyanate groups.

A method that is known and used in the art may be employed as the coating method. For example, the ball may be perched on the tips of needles on a needle bed, and the entire ball coated with various paints by spraying. Prior to coating, any of a variety of techniques may be used to improve adhesion between the object to be coated and the layer of paint. Illustrative, non-limiting examples of such techniques include surface modification by plasma treatment or corona discharge treatment, and the application of a primer.

The color of the ball surface may be suitably set, based on consumer color preferences and self-image, for use by men or for use by women, or may be suitably set, from the standpoint of ball performance, according to the intended purpose of the ball, e.g., as a distance ball or a spin ball, or according to consumer preference. The present invention provides the desired colored golf ball by using the above-described pigment or dye.

The multi-piece solid golf ball of the invention, which can be manufactured so as to conform with the Rules of Golf for competitive play, may be formed to a ball diameter which is not less than 42.67 mm and to a weight which is not more than 45.93 g.

As described above, the multi-piece solid golf ball of the invention has a novel appearance which is bright and highly visible, and also has an excellent durability.

EXAMPLES

The following Examples and Comparative Examples are provided by way of illustration and not by way of limitation.

Examples 1 to 5, Comparative Examples 1 and 2

Solid cores having a diameter of 37.50 mm and a weight of 32.80 g were obtained using a core material of the following formulation composed primarily of cis-1,4-polybutadiene.

Core Formulation

| | |
|---|---|
| cis-1,4-Polybutadiene | 100 parts by weight |
| Zinc oxide | 5.0 parts by weight |
| Barium sulfate | 26.0 parts by weight |
| Antioxidant | 0.1 part by weight |
| Zinc acrylate | 23.0 parts by weight |
| Crosslinking agent (organic peroxide) | 1.2 parts by weight |

Next, in each example, an inner cover layer material of the composition shown in Table 1 was mixed in a kneading-type twin-screw extruder at 200° C. to give an inner cover layer material in the form of pellets. The pelletized material was then injected into a mold in which the above solid core had been placed, thereby producing a ball having an inner cover layer with a thickness of 1.5 mm.

Details of the inner cover layer are shown below.

(1) Nonionic Copolymer

MAA-Based Nonionic Resin (1)

An ethylene-methacrylic acid-isobutylene acrylate ternary copolymer available from DuPont-Mitsui Polychemicals Co., Ltd. under the trade name Nucrel N035C. Acid content, 10 wt %; Mw, 155,000; Mw/Mn, 5.76.

MAA-Based Nonionic Resin (2)

An ethylene-methacrylic acid binary copolymer available from DuPont-Mitsui Polychemicals Co., Ltd. under the trade name Nucrel N2060. Acid content, 20 wt %; Mw, 73,400; Mw/Mn, 3.12.

A material obtained by blending MAA-based nonionic resin (1) and MAA-based nonionic resin (2) in a 50:50 weight ratio was used.

(2) Fatty Acid Metal Salt

Magnesium stearate: Available under the trade name Magnesium Stearate G from NOF Corporation.

(3) Inorganic Metal Salt

Magnesium Oxide

Next, the ionic resins (Himilan (trade name) series) mentioned in Table 1 were used as the chief materials of the outermost cover layer. To this were added predetermined amounts of a specific pigment or dye and a spherical inorganic material. Details on the materials in the outermost cover layer are given below.

(1) Pigment or Dye

Yellow pigment: Sumiplast Yellow, available from Sumika Chemtex Co., Ltd.

Orange pigment: Fasogen Super Orange, available from DIC

Pink pigment: Fasogen Super Red, available from DIC (2) Ionomer Resin (Trade Name: Himilan)

H1557, H1601, H1855 and H1555 belong to the Himilan series available from DuPont-Mitsui Polychemicals Co., Ltd.

(3) Spherical Inorganic Fine Particles $TiO_2$—BaO—$SiO_2$ glass

The trade name is Unitika Beads UB-35M.

The above resin composition was injection molded, thereby fabricating a three-piece solid golf ball having an outermost layer with a thickness of 1.3 mm.

In addition, a non-yellowing type two-component curing urethane paint was applied by spray coating as the paint layer.

As a result, three-piece golf balls having a diameter of 42.7 mm and a weight of 45.1 to 45.2 g were fabricated. The golf balls obtained in the respective examples and comparative examples were evaluated as follows for various properties. The results are shown in Table 1.

Durability

The durability of the golf ball was evaluated using an ADC Ball COR Durability Tester produced by Automated Design Corporation (U.S.). The ball was fired pneumatically and made to repeatedly strike two metal plates arranged in parallel. Using the average number of shots required for the ball to crack, the durability was rated according to the criteria indicated below. (Average values were obtained by furnishing four balls of the same type for testing, repeatedly firing each of the four balls until it cracked, and averaging the number of shots required for the respective balls to crack. The type of tester used was a vertical COR durability tester, and the incident velocity of the balls on the metal plates was 43 m/s.)

Excellent: at least 200 shots

Good: from 120 to 199 shots

Fair: from 80 to 119 shots

NG: 79 shots or less

Perceived Brightness

Sensory evaluations were carried out by ten skilled golfers, and the perceived brightness of the ball was rated based on the following criteria.

Excellent: Eight or more of the ten golfers thought the ball had a bright color.

Good: Five to seven of the ten golfers thought the ball had a bright color.

Fair: Three or four of the ten golfers thought the ball had a bright color.

NG: Two or fewer of the ten golfers thought the ball had a bright color.

Visibility at Dusk

Sensory evaluations were carried out by ten skilled golfers, and the visibility of the ball at dusk was rated based on the following criteria.

Excellent: Eight or more of the ten golfers thought the ball was easy to see even at dusk.

Good: Five to seven of the ten golfers thought the ball was easy to see even at dusk.

Fair: Three or four of the ten golfers thought the ball was easy to see even at dusk.

NG: Two or fewer of the ten golfers thought the ball was easy to see even at dusk.

TABLE 1

| | | Example | | | | | Comparative Example | |
|---|---|---|---|---|---|---|---|---|
| | | 1 | 2 | 3 | 4 | 5 | 1 | 2 |
| Outermost cover layer | Color | yellow | yellow | yellow | orange | pink | yellow | yellow |
| | Pigment or dye | pigment | pigment | pigment | pigment | pigment/ anthra-quinone dye | hetero-cyclic dye | mixed oxide pigment |

TABLE 1-continued

| | | Example | | | | | Comparative Example | |
|---|---|---|---|---|---|---|---|---|
| | | 1 | 2 | 3 | 4 | 5 | 1 | 2 |
| | Amount of pigment or dye | 1.6 | 1.6 | 1.6 | 0.9 | 0.2 | 1.6 | 1.0 |
| | H1557 | 50 | 50 | | 50 | | 50 | 50 |
| | H1601 | 50 | 50 | | 50 | | 50 | 50 |
| | H1855 | | | 50 | | 50 | | |
| | H1555 | | | 50 | | 50 | | |
| | Spherical inorganic fine particles | 5 | 15 | 5 | 10 | 8 | 0 | 25 |
| Inner cover layer | Nonionic copolymer | | | 100 | | | 100 | |
| | Fatty acid metal salt | | | 70 | | | 70 | |
| | Inorganic metal salt | | | 2.3 | | | 2.3 | |
| Ball evaluations | Durability | Exc. | Good | Exc. | Good | Exc. | Exc. | NG |
| | Brightness | Good | Exc. | Good | Exc. | Good | NG | Exc. |
| | Visibility | Good | Good | Good | Good | Good | Fair | NG |

*Ingredient amounts shown above are in parts by weight.

As is apparent from the results in Table 1, the golf balls of Comparative Examples 1 and 2 had the following drawbacks.

In Comparative Example 1, no spherical inorganic filler was added. As a result, although the durability was good, the ball had a poor brightness and a poor visibility at dusk.

In Comparative Example 2, spherical inorganic filler was added in excess. As a result, although a ball appearance having sufficient brightness was obtained, the ball had a poor durability and a poor visibility at dusk.

The invention claimed is:

1. A multi-piece solid golf ball comprising a core, a cover of at least one layer encasing the core, and a layer of paint applied to a surface of an outermost layer of the cover, wherein the outermost cover layer is formed of a resin composition comprising:

(a) 100 parts by weight of a thermoplastic resin, (b) from 0.003 to 2 parts by weight of a color pigment or dye, and (c) from 0.01 to 20 parts by weight of spherical inorganic fine particles as a reflective material, wherein the spherical inorganic fine particles serving as a reflective material (c) are made of a glass material selected from the group consisting of NaO—CaO—$SiO_2$ glasses, $Al_2O_3$—$B_2O_3$—$SiO_2$ glasses, CaO—$Al_2O_3$—$SiO_2$ glasses and $TiO_2$—BaO—$SiO_2$ glasses.

2. The multi-piece solid golf ball of claim 1, wherein the spherical inorganic fine particles are glass beads.

3. The multi-piece solid golf ball of claim 1, wherein the glass material has the following oxide equivalent composition:

(i) when a NaO—CaO—$SiO_2$ glass is used, the oxide equivalent composition is 0.5 to 45 wt % of NaO, 0.5 to 45 wt % of CaO, and 40 to 90 wt % of $SiO_2$;

(ii) when an $Al_2O_3$—$B_2O_3$—$SiO_2$ glass is used, the oxide equivalent composition is 0.5 to 40 wt % of $Al_2O_3$, 0.5 to 40 wt % of $B_2O_3$, and 40 to 90 wt % of $SiO_2$;

(iii) when a CaO—$Al_2O_3$—$SiO_2$ glass is used, the oxide equivalent composition is 0.5 to 45 wt % of CaO, 0.5 to 40 wt % of $Al_2O_3$, and 40 to 90 wt % of $SiO_2$;

(iv) when a $TiO_2$—BaO—$SiO_2$ glass is used, the oxide equivalent composition is 0.5 to 45 wt % of $TiO_2$, 0.5 to 40 wt % of BaO, and 40 to 90 wt % of $SiO_2$.

4. The multi-piece solid golf ball of claim 1, wherein the spherical inorganic fine particles serving as a reflective material (c) have a sphericity (ratio of maximum particle length/minimum particle width) of from 1.00 to 2.00.

5. The multi-piece solid golf ball of claim 1, wherein the spherical inorganic fine particles serving as a reflective material (c) contain a retroreflective material.

6. The multi-piece solid golf ball of claim 1, wherein the color pigment serving as component (b) is selected from the group consisting of red pigments, blue pigments, yellow pigments, green pigments, violet pigments and black pigments.

7. The multi-piece solid golf ball of claim 1, wherein a separate cover layer is additionally present on the inner side of the outermost cover layer, and the material of the cover layer is a heated mixture of the composition comprising:

(i) from 100 to 50 wt % of an olefin-unsaturated carboxylic acid-unsaturated carboxylic acid ester random copolymer and/or a metal salt thereof, and (ii) from 0 to 50 wt % of an olefin-unsaturated carboxylic acid random copolymer and/or a metal salt thereof, in combination with (iii) from 5 to 170 parts by weight of a fatty acid or fatty acid derivative having a molecular weight of from 280 to 1500 per 100 parts by weight of (i) and (ii) as the base resins, and (iv) from 0.1 to 20 parts by weight of a basic inorganic metal compound capable of neutralizing the acid groups in components (i), (ii) and (iii).

8. The multi-piece solid golf ball of claim 7, wherein the olefin used in components (i) and (ii) is ethylene, the unsaturated carboxylic acid used in components (i) and (ii) is methacrylic acid (MAA), and the unsaturated carboxylic acid ester used in components (i) and (ii) is butyl acrylate.

9. The multi-piece solid golf ball of claim 7, wherein components (i) and (ii) are mixed in relative proportions by weight of (i):(ii) =100:0 to 50:50.

10. The multi-piece solid golf ball of claim 7, wherein the fatty acid or fatty acid derivative of component (iii) is magnesium stearate and its amount is from 15 to 90 parts by weight per 100 parts by weight of (i) and (ii) as the base resins.

11. The multi-piece solid golf ball of claim 7, wherein the metal ions in the basic inorganic metal compound of component (iv) are one or more metal ions selected from the group consisting of $Na^+$, $Zn^{2+}$, $Ca^{2+}$ and $Mg^{2+}$, and the amount of the basic inorganic metal compound is set to an amount equivalent to at least 70 mol %, based on the acid groups in components (i), (ii) and (iii).

* * * * *